US006663500B2

(12) United States Patent
Huang

(10) Patent No.: US 6,663,500 B2
(45) **Date of Patent: *Dec. 16, 2003**

(54) ALL-WEATHER COMPOSITE GRIP FOR GOLF CLUBS

(76) Inventor: Ben Huang, 19472 Woodlands La., Huntington Beach, CA (US) 92648

( * ) Notice: Subject to any disclaimer, the term of this patent is extended or adjusted under 35 U.S.C. 154(b) by 0 days.

This patent is subject to a terminal disclaimer.

(21) Appl. No.: 10/107,682

(22) Filed: Mar. 27, 2002

(65) Prior Publication Data

US 2002/0142857 A1 Oct. 3, 2002

Related U.S. Application Data

(63) Continuation-in-part of application No. 10/038,392, filed on Jan. 2, 2002, and a continuation-in-part of application No. 09/705,376, filed on Oct. 30, 2000, now abandoned, and a continuation-in-part of application No. 09/497,750, filed on Feb. 4, 2000, now Pat. No. 6,386,989.

(51) Int. Cl.[7] ..... A63B 49/08

(52) U.S. Cl. ..... 473/300; 473/301; 473/302; 473/303; 473/549

(58) Field of Search ..... 473/300, 301, 473/302, 303, 549

(56) References Cited

U.S. PATENT DOCUMENTS

| | | | | |
|---|---|---|---|---|
| 621,993 A | | 3/1899 | Crosier | |
| 1,017,565 A | | 2/1912 | Lard | |
| 1,665,791 A | | 4/1928 | Novak | |
| 2,280,382 A | * | 4/1942 | Davis | 473/549 |
| 2,941,806 A | | 6/1960 | Stevens | |
| 3,070,370 A | | 12/1962 | Steiner | |
| 3,252,706 A | | 5/1966 | Rosasco, Sr. | |
| 3,311,375 A | | 3/1967 | Onions | |
| 3,524,646 A | | 8/1970 | Wheeler | |
| 4,919,420 A | * | 4/1990 | Sato | 473/203 |
| 5,145,171 A | | 9/1992 | Head et al. | |
| 5,343,776 A | * | 9/1994 | Falco et al. | 74/558 |
| 5,397,123 A | * | 3/1995 | Huang | 473/550 |
| 5,478,074 A | | 12/1995 | Storper | |
| 5,513,845 A | | 5/1996 | Sonagere | |
| 5,620,180 A | | 4/1997 | Hong | |
| 5,626,527 A | | 5/1997 | Eberlein | |
| 5,730,662 A | | 3/1998 | Rens | |
| 5,797,813 A | | 8/1998 | Huang | |
| 5,851,632 A | * | 12/1998 | Chen et al. | 307/10.1 |
| 5,857,929 A | | 1/1999 | Huang | |
| 5,924,941 A | * | 7/1999 | Hagey | 473/551 |

* cited by examiner

*Primary Examiner*—Stephen Blau
*Assistant Examiner*—Tom P Duong
(74) *Attorney, Agent, or Firm*—Fulwider Patton Lee & Utecht LLP

(57) ABSTRACT

A golf club grip made up of a composite strip that includes a first segment to the upper surface of which is bonded a layer of polyurethane, with the upper surface of the polyurethane being embossed with a friction enhancing pattern grasped by a golfer's hands, and a second segment having a felt layer to the upper surface of which is bonded a fabric fiber mesh by a coating of polyurethane. The mesh defines slip-resistant grooves in the polyurethane. One side edge of the first segment is adhesively attached to a side edge of the second segment. The strip is spirally wrapped about a resilient underlisting sleeve or directly about the handle of a golf club.

20 Claims, 8 Drawing Sheets

FIG. 28
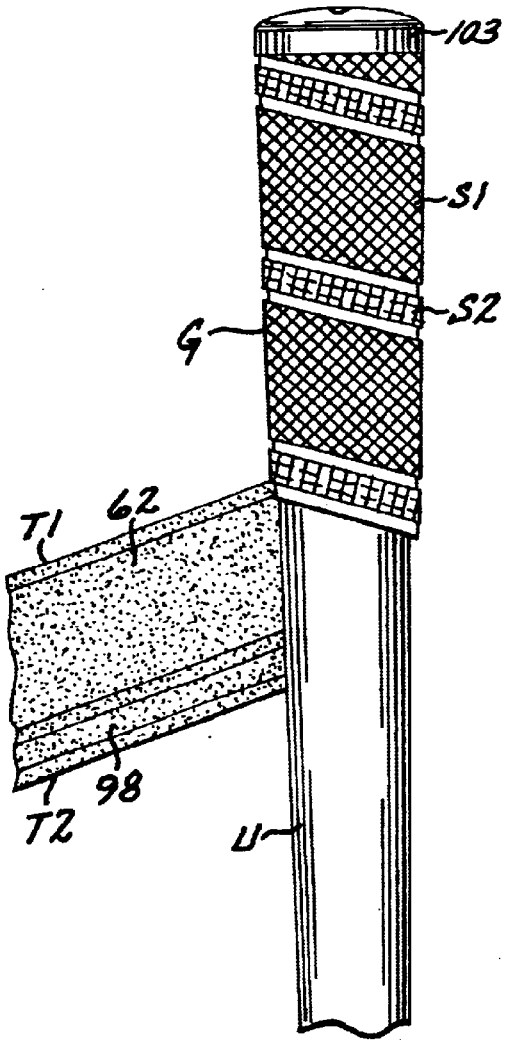
FIG. 29
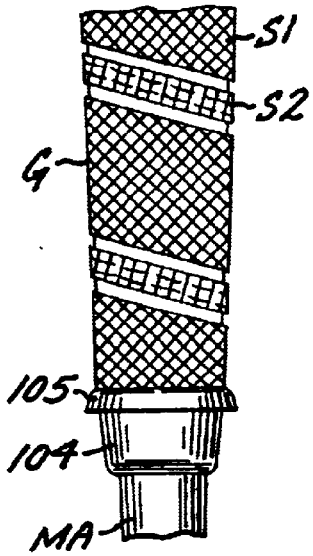
FIG. 30
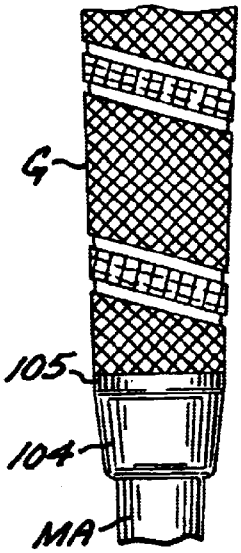
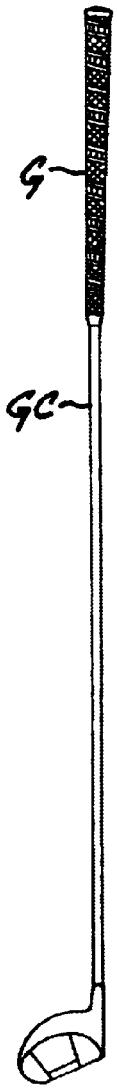
FIG. 31
FIG. 32
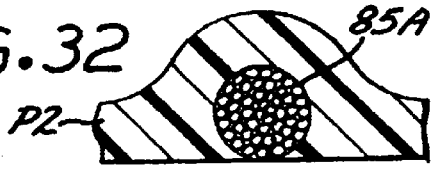
FIG. 33
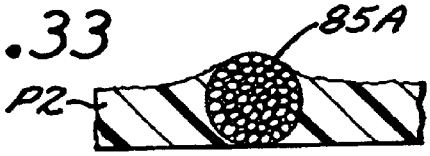

ALL-WEATHER COMPOSITE GRIP FOR GOLF CLUBS

RELATED U.S. APPLICATION DATA

This application is a continuation in part of Ser. No. 09/705,376 filed by me Oct. 30, 2000, now abandoned, a continuation-in-part of Ser. No. 10/038,392, filed Jan. 2, 2002, and a continuation-in-part of Ser. No. 09/497,750, filed by me Feb. 4, 2000, now U.S. Pat. No. 6,386,989.

BACKGROUND OF THE INVENTION

The present invention relates to a golf club grip for all-weather use.

Applicant has previously developed resilient grips which successfully reduce shock to the muscle and arm joints of the users of golf clubs, tennis racquets, racquet ball racquets, baseball bats and other impact imparting devices. See, for example, U.S. Pat. No. 5,797,813 granted to applicant Aug. 25, 1998. Such earlier grips utilize a polyurethane layer bonded to a felt layer to define a strip which is spirally wrapped around the handle of a golf club, racquet or the like to conform to the external configuration or such handle. In certain of such grips the sides of the felt layer taper from the side edges of the strip and the polyurethane layer is formed with recessed reinforcement side edges which overlap to form a water retarding joint between the side edges of the strip as the strip is wrapped around the handle or over a resilient sleeve telescopically carried by the golf club handle. A problem common to polyurethane-felt golf club is slippage of the grip when moisture accumulates thereon as from rainy or humid conditions or from perspiration. Such slippage can result in diminished control of the golf club resulting in misdirected shots thereby reducing the enjoyment of the game to the golfer.

To reduce such slippage between a golf club grip and a golfer's hands there have been provided cord-type grips providing a roughened surface to the golfer's hands. Such cord-type grips however, feels stiff and uncomfortable to a golfer, particularly in dry weather conditions, although such grips afford reasonable slip-resistance between a golf club grip and a golfer's hands during wet playing conditions.

SUMMARY OF THE INVENTION

A preferred golf club grip embodying the present invention utilizes a composite two-piece grip, one segment being of polyurethane-felt construction, wherein the polyurethane layer is embossed with a friction enhancing pattern engaged by a golfer's hands, and the other segment being of a polyurethane-fiber mesh construction. Each segment may be of a different width. The two segments may be of different colors so as to provide a golf club grip of a unique decorative appearance. The two segments are adhered together to define an elongated resilient strip. When the strip is installed on a golf club, the polyurethane-felt segment absorbs shocks and also inhibits slippage of a user's hand, while the polyurethane-fiber mesh segment provides additional friction to slippage of a golfer's hands on the grip, particularly under wet or humid conditions such as exist during rain. The polyurethane-fiber mesh segment affords a slip resistance similar to that of a conventional cord-type grip. In this manner, the golf club grip of the present invention provides maximum control of a golf club by a golfer under either wet or dry conditions. Such control is especially critical when a golfer takes a full swing of the golf club.

The composite strip of the present invention may be spirally wrapped about a tapered resilient underlisting sleeve, with such sleeve being slipped onto the handle of a golf club shaft. Alternatively, the strip may be directly spirally wrapped about the handle of a golf club, tennis racquet or the like. When the two-piece strip is spirally wrapped about an underlisting sleeve, the sleeve may be positioned on a collapsible mandrel to provide a slip-on golf club grip that can be applied to a new golf club or can be utilized as a replacement golf club grip.

These and other advantages of the present invention will become apparent from the following description and accompanying drawings.

BRIEF DESCRIPTION OF THE DRAWINGS

FIG. 28 is a broken side elevational view showing a composite strip embodying the present invention being wrapped around an underlisting sleeve to form a golf club grip;

FIGS. 29 and 30 are broken side elevational views showing the lower end of the composite strip of FIG. 28 being secured to the lower portion of the underlisting sleeve;

FIG. 31 is a perspective view showing a golf club grip embodying the present invention applied to the handle of a golf club; and FIGS. 32 and 33 show how the polyurethane-layer of the polyurethane-felt segment can be buffed to expose the fibers of such segment.

DETAILED DESCRIPTION OF PREFERRED EMBODIMENT

Figure 1:
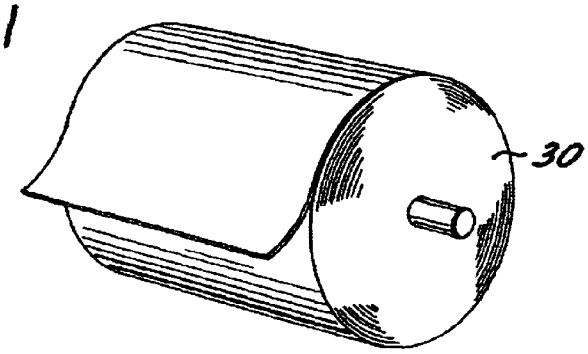
FIG. 1 is perspective view of a roll of polyurethane-felt material utilized in making the wider segment of a composite grip embodying the present invention.

Referring to the drawings, a preferred form of grip G embodying the present invention utilizes an elongated composite two-piece strip S which is spirally wrapped around a resilient underlisting sleeve U which is slipped onto the handle of a golf club GC as shown in FIGS. 28–31. Such strip may also be applied to the handle of other imparting devices (not shown) such as a tennis racquet.

More particularly, strip S is fabricated from first and second individual segments S1 and S2 of different widths, with segment S1 preferably being wider than segment S2. Segment S1 includes a polyurethane layer P1 and a backing layer B1, preferably of felt. The underside of the backing layer B1 is originally covered with a conventional double adhesive-sided peel-off tape T. All or substantially all of the upper surface of polyurethane layer P1 is heat embossed with a friction enhancing pattern F engaged by a golfer's hands by means of a method described hereinafter.

More particularly, referring to FIGS. 1–15 there is shown a preferred method of making the wider segment S1 from a roll 30 of polyurethane-felt material. The felt layer B1 is formed of a suitable open-pored material such as nylon, cotton, wool or the like, and has its upper or outer surface bonded to the lower surface of the polyurethane layer P1. The polyurethane layer P1 is formed with pores (not shown) which extend vertically, i.e., generally normal to the longitudinal axis of the strip S and racquet handle or golf club handle when the grip has been affixed to such handle. The polyurethane layer P1 may be formed in a conventional manner by coating one side of a felt strip with a solution of polyurethane (e.g., polyester or polyether) dissolved in a dimethyl formamide (DMF), immersing the coated strip in water baths to displace the DMF and cause the urethanes to coagulate, and finally driving off the water by the application of pressure and heat. In this manner, the pores will extend perpendicularly relative to the longitudinal axis of the strip, while the underside of the polyurethane layer P1 is bonded to the upper surface of the felt strip. Other materials may be substituted for felt as a backing layer B1 to provide strength for polyurethane layer P1, e.g., a synthetic plastic such as an ethylene-vinyl acetate copolymer, commonly known as EVA.

Figure 2:
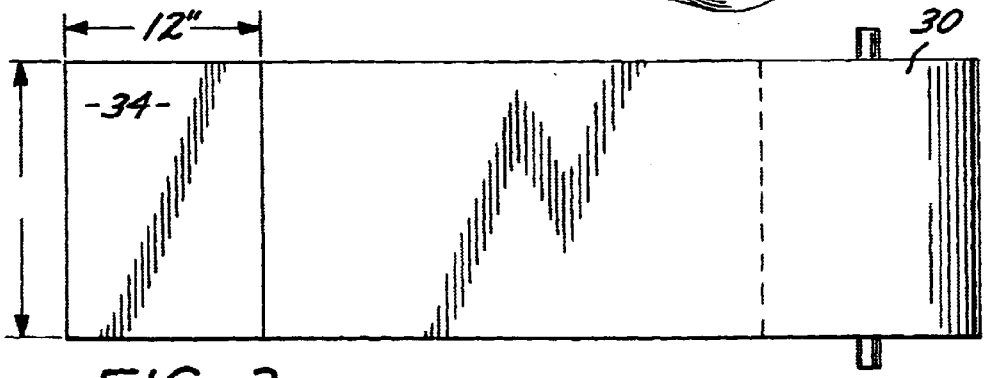
FIG. 2 is a top plan view showing the roll of FIG. 1 being dimensioned into a panel.
Figure 3:
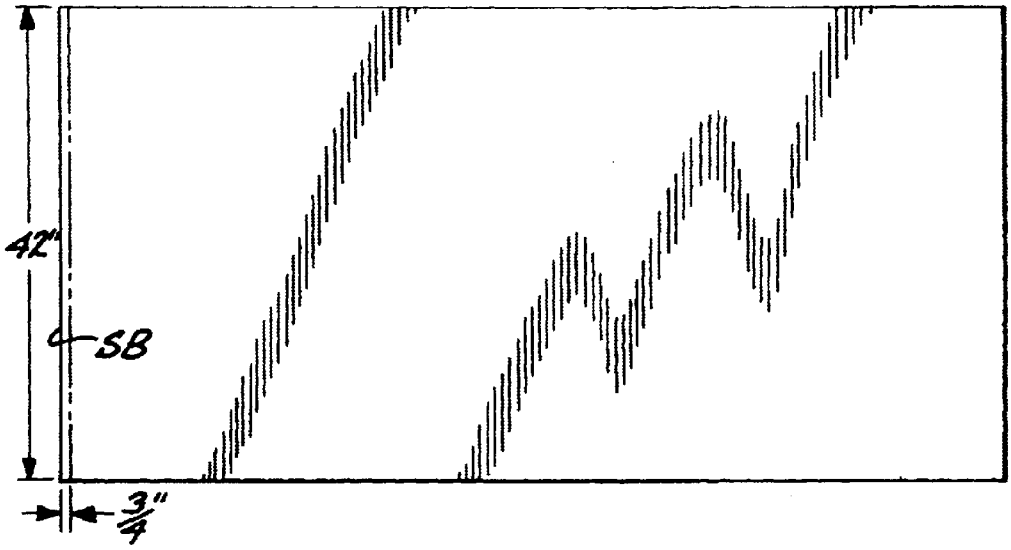
FIG. 3 is a top plan view showing a portion of the panel of FIG. 2 dimensioned for cutting therefrom a plurality of wider segment strip blanks in accordance with the present invention.
Figure 4:
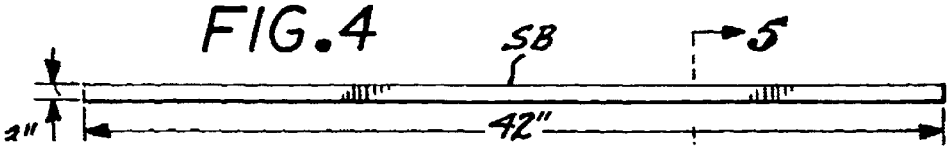
FIG. 4 is a top plan view of a wider segment strip blank cut from the panel of FIG. 3.
Figure 5:
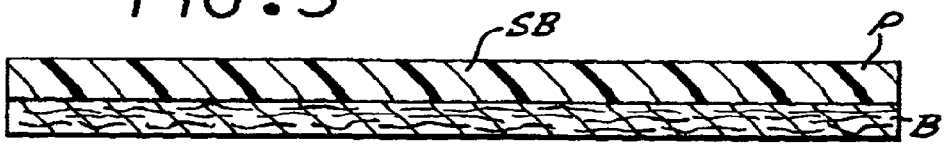
FIG. 5 is a vertical sectional view taken in enlarged scale along lines 5—5 of FIG. 4.
Figure 6:
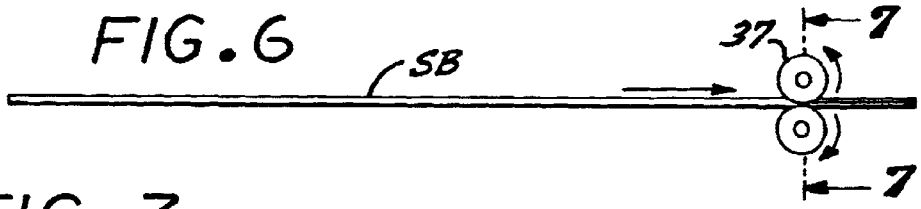
FIG. 6 is a reduced vertical sectional view showing heat recessed reinforcement side edges being formed in the polyurethane layer of the wider segment strip blank of FIG. 5.
Figure 7:
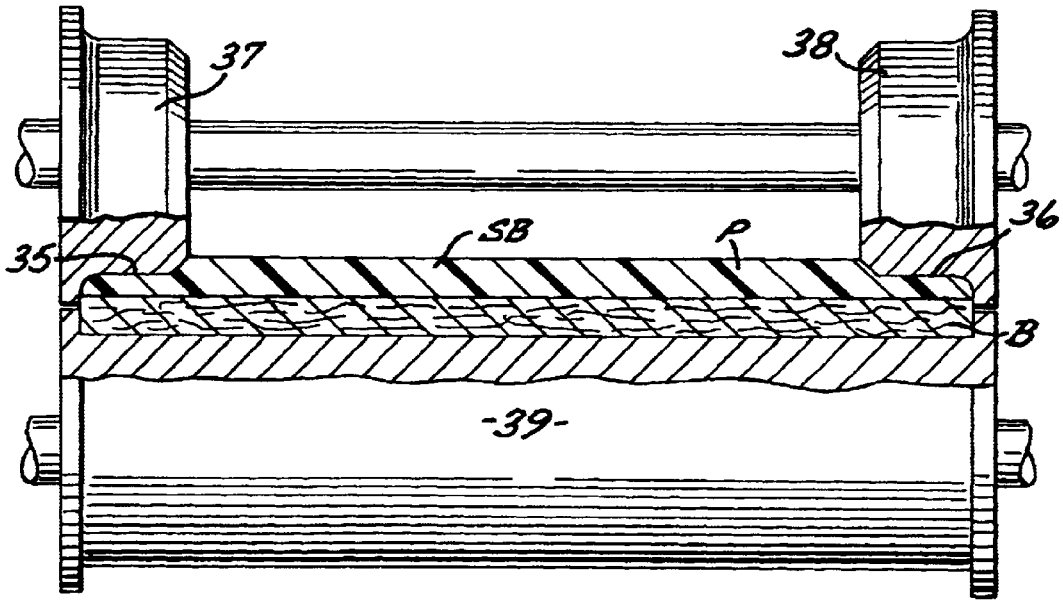
FIG. 7 is a vertical sectional view taken in enlarged scale along line 7—7 of FIG. 6.
Figure 8:
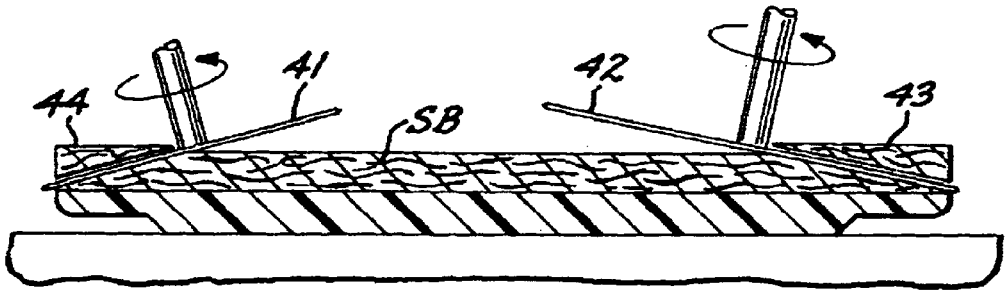
FIG. 8 is a vertical sectional view showing the side edges of the wider segment strip blank of FIG. 7 being skived to define slanted side edges in such blank.
Figure 9:
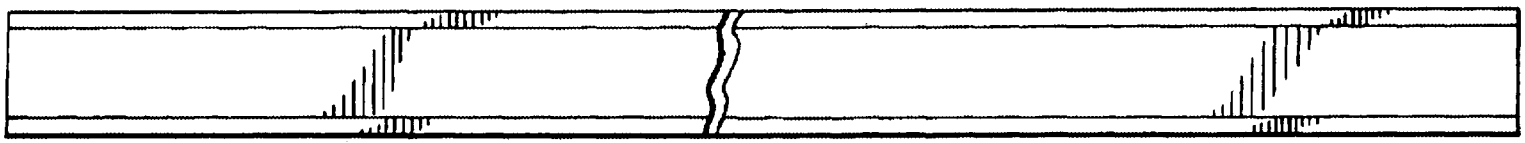
FIG. 9 is a top plan view of a wider segment strip blank before its upper surface is heat embossed with a friction enhancing pattern.

Referring now to FIGS. 1–5, there is shown an arrangement for cutting a blank SB from roll 30 from which is formed the wider segment S1 of strip S. In FIG. 2, a panel 34 of the polyurethane-felt material is cut from roll 30. By way of example the width of such panel can be 42 inches, and the length 12 inches. A plurality of wider segment blanks SB can be cut from the panel 34 as shown in FIGS. 3 and 4, with each such strip having a width of ¾ inch by way of example. A resulting blank SB is shown in FIGS. 4 and 5. In FIGS. 6 and 7 the sides of the polyurethane layer P1 of the blank are shown being formed with recessed reinforcement edges 35 and 36 as by means of heated rollers 37, 38, and 39 such as shown in my U.S. Pat. No. 6,203,308. In FIG. 8, the sides of the felt layer B1 are shown being skived as by rotating knives 41 and 42 in a conventional manner so as to define the slanted side edges 43 and 44 of a completed wider segment S1 of composite strip S.

Figure 10:
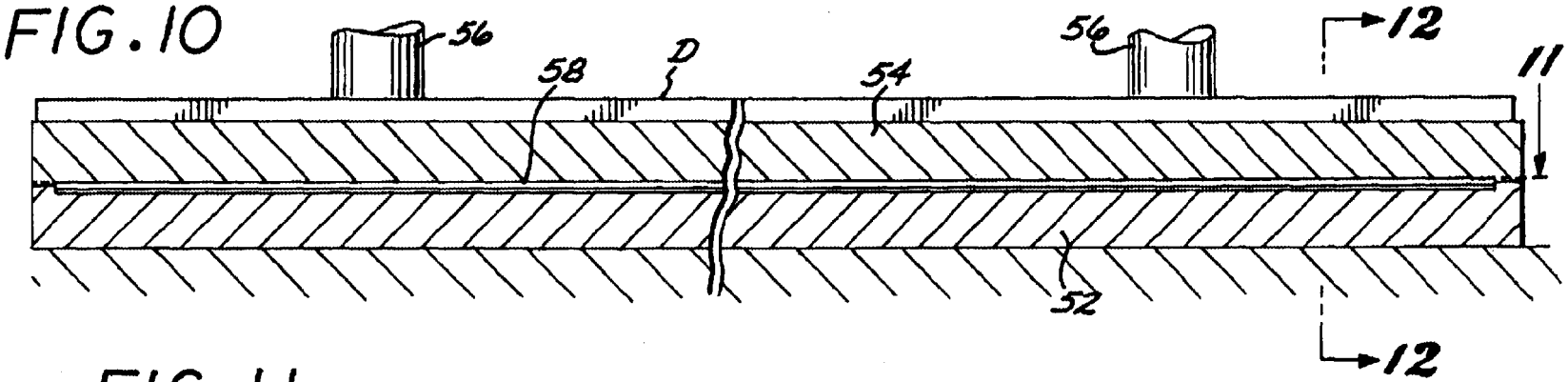
FIG. 10 is a vertical sectional view of a die used to heat emboss the upper surface of the wider segment strip blank with a friction enhancing pattern.
Figure 11:
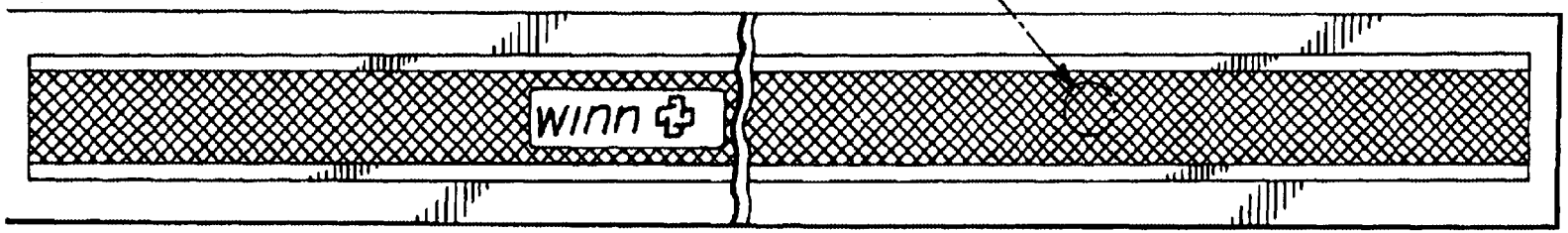
FIG. 11 is a horizontal sectional view taken along line 11—11 of FIG. 10.
Figure 12:
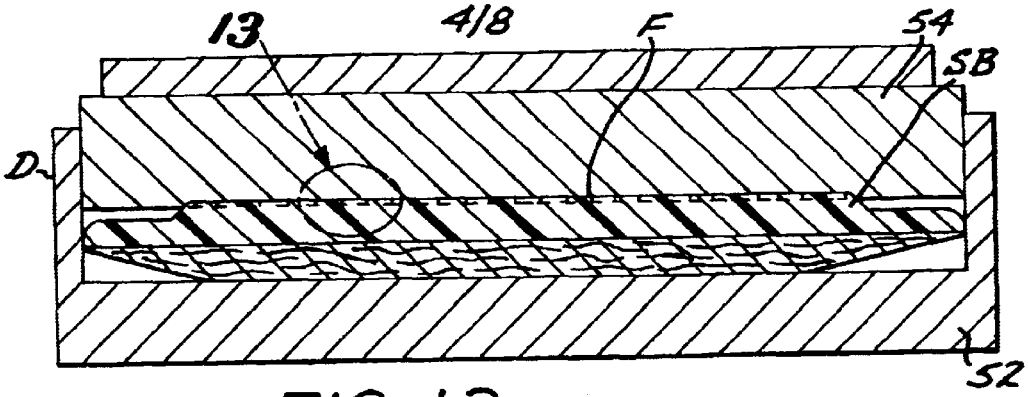
FIG. 12 is a vertical sectional view taken in enlarged scale along line 12—12 of FIG. 10.
Figure 13:
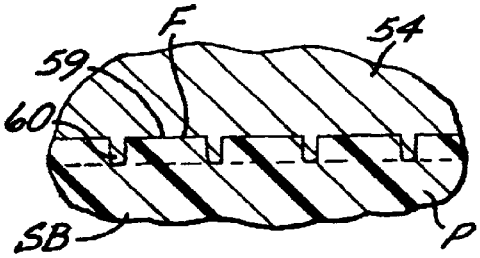
FIG. 13 is an enlarged side view of the encircled area 13 in FIG. 12.
Figure 14:
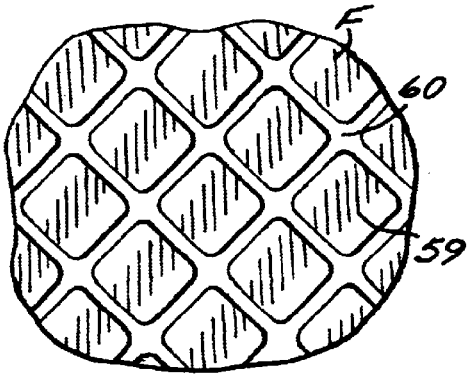
FIG. 14 is an enlarged top view of the encircled area 14 in FIG. 11.
Figure 15:
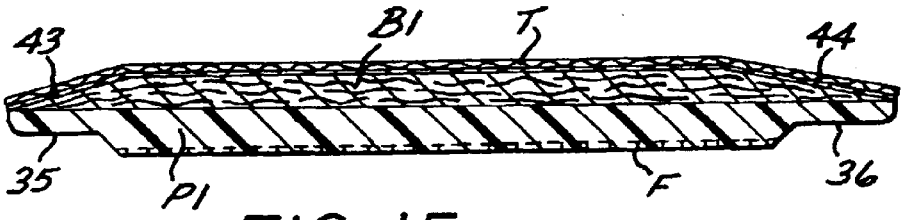
FIG. 15 is a vertical sectional view of a finished strip segment embodying the present invention.
Figure 16:
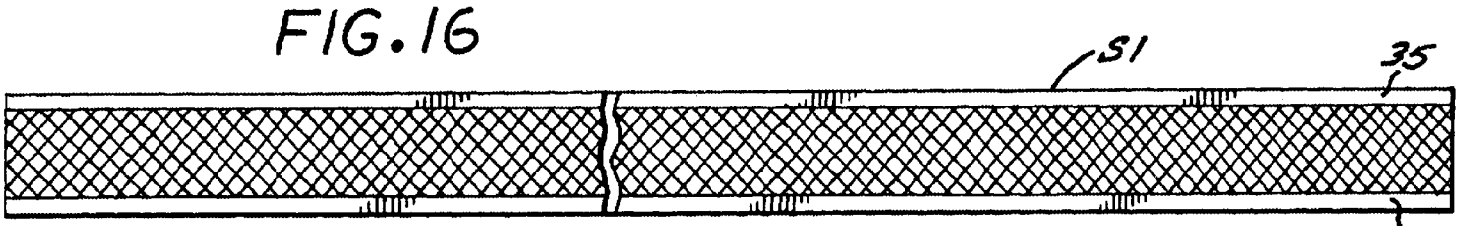
FIG. 16 is a broken top plan view of the heat embossed upper surface of the strip blank of FIG. 15.

Referring now to FIGS. 10–12, there is shown a heated steel die D utilized to form a friction enhancing pattern F on the upper surface of the wider segment blank SB. Die D includes a bottom half 52 and a complementary upper half 54. Upper die half 54 is vertically movable relative to the lower die half by power-operated plungers 56 in a conventional manner. The underside of upper die half 54 is engraved to define friction enhancing pattern F. A cavity 58 is formed between the upper and bottom die halves to removably receive a wider segment blank SB that is to be formed with pattern F. With blank SB disposed in the cavity, upper die-half 54 is urged downwardly into the polyurethane layer PI so as to partially permanently depress such layer and concurrently heat emboss pattern F upon the upper surface of such layer. Such heat embossing increases the density of the polyurethane layer with a resulting increase in the strength of this layer. The magnitude of density increase is generally proportional to the thickness of the strip S. By way of example, where the strip thickness is 1.8 mm, the felt layer can be 1.4 mm as compared to a 0.4 mm polyurethane layer, and the polyurethane layer can be decreased in thickness 0.07–0.1 mm. Heat embossing the polyurethane layer P also renders such layer substantially water-tight. FIG. 16 shows the upper surface of the wider segment S1 embossed with friction enhancing pattern F.

Friction enhancing pattern F includes a large number of small repetitive shapes 59, such as squares or diamonds, with the interstices 60 of these shapes cooperating to collect water that may accumulate on the outer surface of the wider segment. When a grip G utilizing the wider segment S1 is wetted, as by rain, water collected in these interstices 60 can be readily removed by wiping the grip with a towel (not shown). The grip is then immediately ready for continued play despite the rain. During dry playing conditions, friction enhancing pattern F resists slippage between grip G and a golfer's hands.

Figure 17:
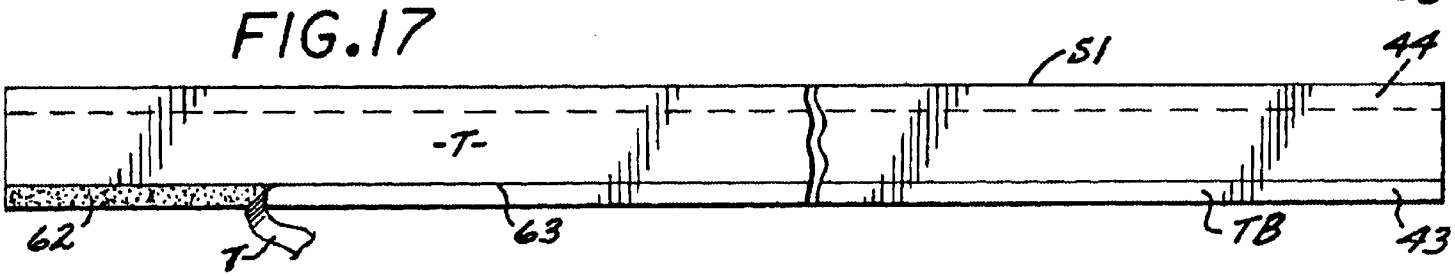
FIG. 17 is a broken view showing a peel-off adhesive tape being removed from the underside of the strip blank of FIG. 16.
Figure 18:
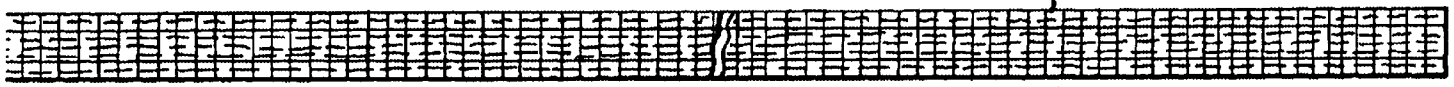
FIG. 18 is a broken top plan view of a polyurethane-felt strip blank utilized in making the narrower segment of a composite strip embodying the present invention.

Referring now to FIG. 17, the entire underside of backing layer B1 of wider segment S1 is provided with an adhesive 62 initially covered in a conventional manner by a peel-away tape T. Peel-away tape T includes a score line 63 over skived edge 43 which defines a thin band TB which can be pulled off the main body of tape T to expose adhesive 62 disposed on one edge of wider segment S1, while the tapes' main body remains on the adhesive covering the remainder of the wider segment S1.

Narrower segment S2 includes an open-pored bottom backing layer, generally designated B2, (preferably of felt), having an inner or bottom surface which is adhered to underlisting sleeve U. Segment S2 also includes a top layer P2 of a suitable resilient plastic material such as polyurethane, with the polyurethane layer being bonded to the upper surface of its adjacent backing layer B2. The polyurethane layer of strip segment S2 may be formed in a conventional manner by coating a felt strip with one or more solutions of polyurethane (e.g., polyester or polyether) dissolved in a dimethyl formamide (DMF), immersing the coated strip in water baths to displace the DMF and cause the urethane to coagulate, and finally driving off the water by the application of pressure and heat. In this manner, pores are formed (not shown), while the underside of the polyurethane layer is bonded to the upper surface of the felt layer. The thickness of the polyurethane layer is preferably about 0.2–1.40 millimeters and the thickness of the felt layer is about 0.7–1.90 millimeters.

The felt layer B2 serves as a backing layer for the polyurethane layer P2 and so as to provide strength for the polyurethane. The felt also cooperates with the polyurethane to assist in cushioning the shocks applied to a grip when a golf ball is struck by a golf club. It should be noted that other materials may be substituted for the felt as a backing layer to provide strength for the polyurethane and to cushion shocks, e.g., a synthetic plastic such as an ethylene-vinyl acetate copolymer, commonly known as EVA. The felt may be fabricated of conventional suitable materials such as nylon, cotton, polyester or the like.

Figure 20:
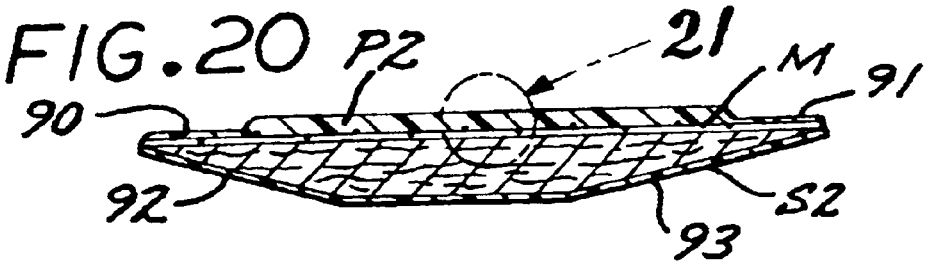
FIG. 20 is a vertical sectional view taken in enlarged scale along line 20—20 of FIG. 19.
Figure 21:
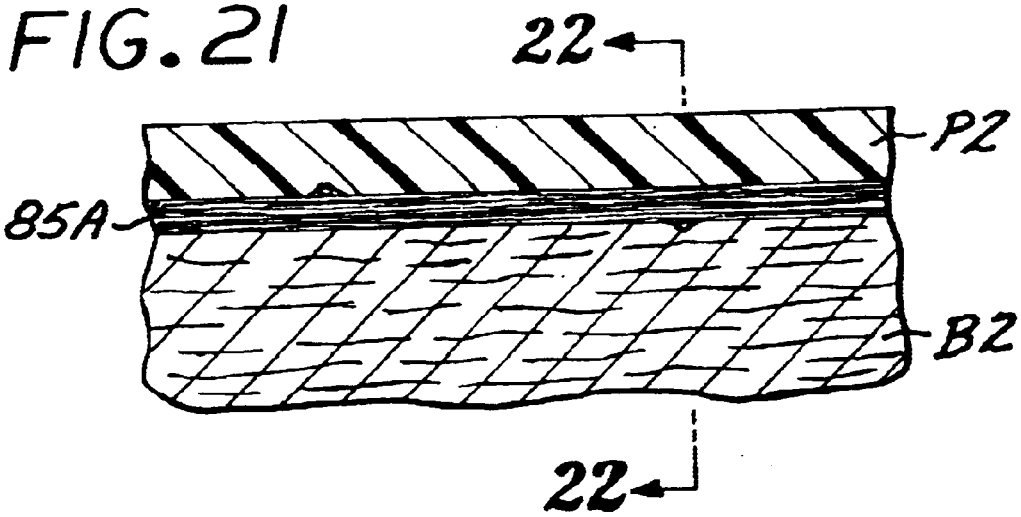
FIG. 21 is an enlarged view of the encircled area designated 21 in FIG. 20.

As shown in FIGS. 20, 21 a mesh M formed of fabric fibers 85A and 85B is laid over backing layer B2, with a coating of polyurethane 86 bonding the fibers to the top of the backing layer B2. The longitudinally extending fibers 85A will preferably be of a larger diameter than the transversely extending fibers 85B with respect to the longitudinal axis of segment S2. For example, the longitudinal fibers may have a diameter of 0.04–0.75 mm and the transverse fibers have a diameter of 0.05–0.25 mm, however, the longitudinal and transverse fibers may be substantially equal in diameter. The felt layer and the fabric fibers 38A and 38B may be fabricated of conventional suitable materials such as nylon, cotton, polyester or the like.

Figure 22:
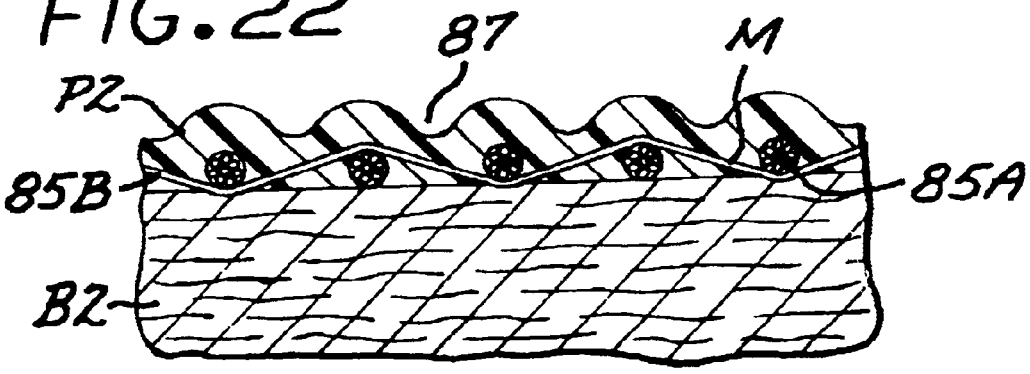
FIG. 22 is a further enlarged sectioned view taken along line 22—22 of FIG. 21.

A suitable arrangement for coating felt and fabric mats with liquid polyurethane is disclosed in my U.S. Ser. No. 09/705,376 filed by me Oct. 30, 2000, now abandoned. In such arrangement, attached together felt and fabric mesh mats are carried by a guiding cloth secured to the front end of the mats from a supply roller to a receiver roller. The guide cloth extends over a coating roller positioned below a polyurethane dispensing nozzle with liquid polyurethane. The guiding cloth then moves the mats through a water bath over a plurality of rollers so as to coagulate the liquid polyurethane. The thickness of the polyurethane layer should be sufficient to cover and impregnate the fibers of the mesh. The mats are then carried through a water cleaning bath by rollers. After the polyurethane has cured, the mats can be cut into the elongated segments S2. The polyurethane serves to bond-together the felt layer and the mesh. As shown in FIG. 22, the larger fibers 85A of the fabric mesh serves to form a parallel corrugations or slip-resistant grooves 87 in the outer surface of the polyurethane 86 as the polyurethane cures. Also, it is important to note that the surface of polyurethane 86 shown in FIG. 32 can be buffed to a degree to partially expose the fabric fibers 85A to increase friction between golfers' fingers and grip to reduce slippage, as shown in FIG. 33. The partially exposed fibers will resemble the cords of a cord-type grip in both feel and appearance. Such buffing may be accomplished as by rotating a brush made of a suitable fabric or other textile against the surface of the polyurethane.

Figure 19:
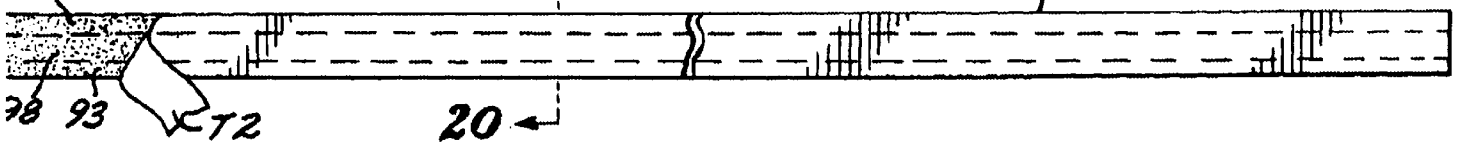
FIG. 19 is a broken view showing the underside of the strip blank of FIG. 19 with a peel-off tape being removed therefrom.

Referring again to FIG. 20, the side edges of the polyurethane layer of B2 of narrower segment S2 are formed with sidewardly and outwardly extending reinforcement side edges 90 and 91 as by means of power-rotated heated rollers which compress and therefore densify the side edges of the polyurethane layer. Also, as shown in FIG. 20, the side edges of the bottom backing layer B2 of segment B2 have been skived to form outwardly and upwardly slanted side edges 92 and 93. As shown in FIG. 19, the entire underside of backing layer B2 is then provided with an adhesive 98 initially covered in a conventional manner by a peel-away tape T2.

Figures 23, 24, 25, 26, 27:
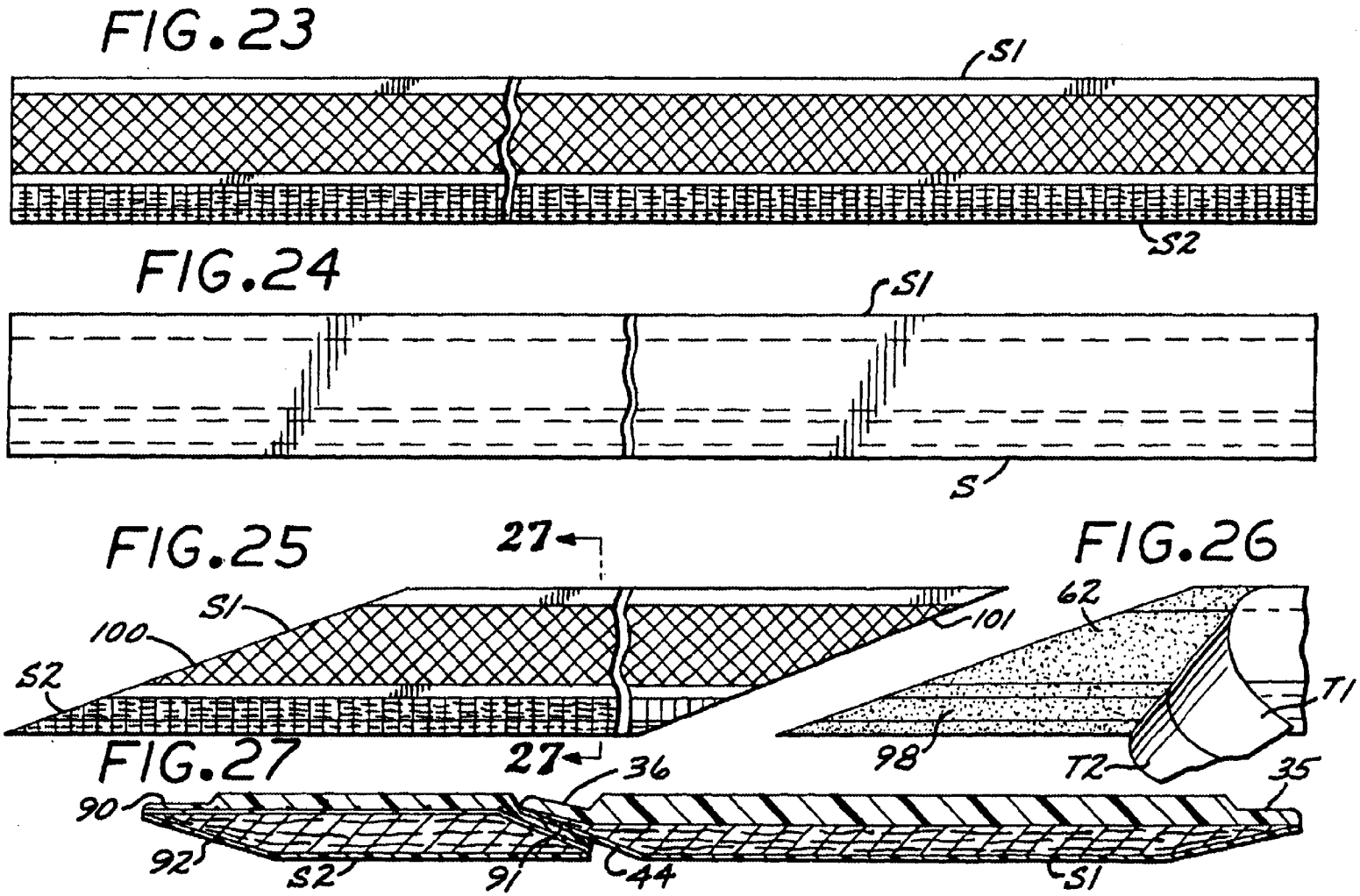
FIG. 23 is a broken top plan view of the wider and narrower strip blank adhered together along one of their side edges.
FIG. 24 is a broken bottom view showing the underside of the strip blanks of FIG. 23.
FIG. 25 is a broken bottom view of the adhered-together strip blanks after the leading and trailing edges have been cut therefrom.
FIG. 26 shows the underside of the strip blanks with the protective tape being peeled off the leading edge thereof.
FIG. 27 is a vertical sectional view taken in enlarged scale along line 27—27 of FIG. 25.

To combine segments S1 and S2 into strip S, tape band TB is peeled off the underside of segments S1 to expose adhesive 62. Recessed side edge 91 of segment S2 is then adhered to the skived side edge 91 of segment S1, as shown in FIGS. 27 to define composite strip S. The strip S is then cut on both ends to create starting and trailing edges 100 and 101, as shown in FIGS. 25 and 26.

Referring now to FIGS. 28–31, there is shown a resilient rubber-like underlisting U which can be utilized in forming a slip-on grip G of the present invention, and is of the type shown in my U.S. Pat. No. 6,386,989. Underlisting sleeve U is fabricated of a synthetic plastic foam or rubber utilizing an integral cap 103. Below the cap 103 there is formed a groove (not shown) to receive the starting end 100 of a completed composite strip S described hereinabove. The lower end of the sleeve U is formed with an integral nipple 104. The upper portion of the nipple is provided with a resilient lip 105. To apply composite strip S to the underlisting sleeve U, the paper of the protective tapes is peeled-off to expose adhesives 62 and 98, as indicated in FIG. 28. The strip S is then spirally wound around the underlisting sleeve U, the tip of the strip starting edge of the strips being first inserted below cap 103 of the sleeve whereafter the strip is wrapped about one and a half times around the upper or butt end of the sleeve to provide a smooth configuration of the strip on the sleeve. With continued reference to FIG. 29, as the composite strip S is wrapped around the underlisting sleeve U, the underside of the recessed side edges of the polyurethane layer of the strips S1 and S2 overlap one another with such edges being secured together in a water-tight manner by adhesives 62 and 98. When the lower edge of the strip has been spirally wound to a position wherein its lower edge is disposed in horizontal alignment with the upper portion of the nipple, lip 105 is folded downwardly, and the lower portion of the strip is wrapped about the upper portion of the nipple. The lip then snaps back to its original position, and will securely retain the lower end of the strip S on the nipple to prevent unraveling of the composite strip and also provide a nicely finished appearance of the grip. It should be understood that the underlisting sleeve U may be disposed upon a conventional collapsible mandrel MA as the strip is wrapped therearound. After the composite strip and sleeve combination is removed from the mandrel MA such combination will define the aforedescribed strip G which is slipped over the handle of a golf club as shown in FIG. 31.

From the foregoing description it will be seen that the golf club grip of the present invention is truly an all weather grip which can resist twisting of a golf club handle relative to a golfer's hands under both wet and dry conditions. Under rainy conditions the grip can be maintained dry by merely wiping it off with a towel. Under dry conditions the friction generated between a golfer's hands and the repetitive shapes of the friction enhancing pattern F in combination with the friction generated between a golfer's hands and the grooves 87 formed by the fibers 85A, resists twisting of a golf club handle without requiring the golfer to tightly grasp the grip. The densification of the polyurethane layer during the heat embossing thereof strengthens the grip, resulting in a light weight construction permitting a higher club-head speed with no loss of accuracy. Such densification also affords a high resistance against unraveling of the strip relative to the underlisting sleeve. Finally, the combination of the friction enhancing pattern F and the grooves 87 affords a distinctive appearance for the grip particularly when the first and second segments are of different colors.

While a particular form of the invention has been illustrated and described, it will also be apparent to those skilled in the art that various modifications can be made without departing from the spirit and scope of the invention. Accordingly, it is not intended that the invention be limited except by the appended claims.

What is claimed is:

1. A golf club grip that includes an elongated composite strip, said strip comprising:

a first segment having a backing layer to the upper surface of which is bonded a layer of polyurethane, with the upper surface of the polyurethane being heat-embossed with a friction enhancing pattern engaged by a players hands, the friction enhancing pattern defining water collection interstices, with water collected in the interstices being readily wiped off to dry the outside of the strip;

the heat embossing also rendering the polyurethane layer substantially water-tight;

a second segment having a backing layer to the upper surface of which is bonded a mesh formed of fabric fibers by means of a coating of polyurethane and with fibers of the mesh defining slip-resistant grooves in the upper surface of the polyurethane coating;

adhesive on the underside of the backing layers of the first and second segments; and with a side edge of the first segment being adhesively attached along one of its side edges to a side edge of the second segment to define said composite strip.

2. A golf club grip as set forth in claim 1, wherein the backing layers are felt.

3. A golf club grip as set forth in claim 1, wherein the backing layers include an EVA.

4. A golf club grip as set forth in claim 1, wherein the friction enhancing pattern includes a large number of repetitive shapes which define the water collection interstices.

5. A golf club grip as set forth in claim 4 wherein the coating of polyurethane on the second segment is buffed to partially expose the longitudinally extending fibers.

6. A golf club grip as set forth in claim 1 wherein some of the fibers extend longitudinally and the other of the fibers extend transversely with respect to the longitudinal axis of the second segment, and the longitudinally extending fibers are thicker than the transversely extending fibers and define said grooves.

7. A golf club grip as set forth in claim 6 wherein the side edges of the polyurethane layers of the first and second segments are heat-compressed so as to define recessed reinforcement side edges and slanted skived side edges are formed along the length of the backing layer of such segments.

8. A golf club grip as set forth in claim 7, wherein the adhesive of the backing layer of the first segment is initially covered by a peel-off tape that is scored along one side to define a band that covers a skived side edge of said backing layers, said band being removed for attachment to a recessed reinforcement side edge of the second segment.

9. A golf club grip as set forth in claim 7, wherein the backing layers are of felt.

10. A golf club grip as set forth in claim 7, wherein the backing layers include an EVA.

11. A slip-on golf club grip, comprising:

a strip having a first segment that includes a backing layer to the upper surface of which is bonded a layer of polyurethane, with the upper surface of the polyurethane being heat-embossed with a friction enhancing pattern engaged by a players hands, the friction enhancing pattern defining water collection interstices, with water collected in the in the interstices being readily wiped off to dry the outside of the strip;

the heat embossing also rendering the polyurethane layer substantially water-tight;

a second segment that includes a backing layer to the upper surface of which is bonded a mesh formed of fabric fibers by means of a coating of polyurethane and with fibers of the mesh defining slip-resistant grooves in the upper surface of the polyurethane coating;

adhesive on the underside of the felt layers;

with a side edge of one segment being adhesively attached along its side edge to a side edge of the other segment to define said strip; and a resilient underlisting sleeve about which the strip is spirally wrapped and adhered.

12. A golf club grip as set forth in claim 11, wherein the friction enhancing pattern includes a large number of repetitive shapes which define the water collection interstices.

13. The combination as set forth in claim 11, wherein the adhesive of the backing layer of the first segment is initially covered by a peel-off tape that is scored along one side to define a band that covers a skived edge of said backing layer, said band being removed for attachment to a recessed reinforcement side edge of the second segment.

14. The combination as set forth in claim 11, wherein heat compressed radially inwardly extending reinforcement side edges are formed in the polyurethane layer of the segments along the length of the segments, and slanted side edges are formed along the length of the backing layer of the segments whereby when the strip is spirally wrapped about the sleeve to define said grip the underside of the adjoining recessed side edges are overlapped by the slanted side edges to define a water retarding joint between the adjoining side edges.

15. The combination as set forth in claim 11 wherein some of the fibers extend longitudinally with respect to the longitudinal axis of the second segment and the other of the fibers extend transversely with respect to the longitudinal axis of the second segment, and the longitudinally extending fibers are thicker than the transversely extending fibers so as to form said grooves.

16. A golf club grip as set forth in claim 15, wherein the coating of polyurethane on the second segment is buffed to partially expose the longitudinally extending fibers.

17. The combination of claim 16, wherein the segments are of different widths and colors.

18. The combination of claim 16, wherein the segments are of different colors.

19. The combination as set forth in claim 11, wherein the segments are of different widths.

20. The combination as set forth in claim 11, wherein the segments are of different colors.

* * * * *

UNITED STATES PATENT AND TRADEMARK OFFICE

CERTIFICATE OF CORRECTION

PATENT NO. : 6,663,500 B2
APPLICATION NO. : 10/107682
DATED : December 16, 2003
INVENTOR(S) : Ben Huang, Ph. D.

It is certified that error appears in the above-identified patent and that said Letters Patent is hereby corrected as shown below:

At sheet 4 of 8, above "FIG. 12", please delete "4/8".
At column 1, line 5, please delete "continuation in part" and insert -- continuation-in-part --, therefor.
At column 7, line 48, claim 5, after "claim 4" insert --,--.
At column 7, line 51, claim 6, after "claim 1" insert --,--.
At column 7, line 57, claim 7, after "claim 6" insert --,--.
At column 8, line 14, claim 11, after "in the" delete "in the".
At column 8, line 47, claim 15, after "claim 11" insert --,--.

Signed and Sealed this

Fourteenth Day of November, 2006

JON W. DUDAS
*Director of the United States Patent and Trademark Office*